US009033904B2

(12) United States Patent
DiGiacomo

(10) Patent No.: US 9,033,904 B2
(45) Date of Patent: May 19, 2015

(54) VIBRATION DEVICE FOR COMFORTING AN INFANT

(76) Inventor: Tim DiGiacomo, Malvern, IA (US)

( * ) Notice: Subject to any disclaimer, the term of this patent is extended or adjusted under 35 U.S.C. 154(b) by 765 days.

(21) Appl. No.: 13/307,027

(22) Filed: Nov. 30, 2011

(65) Prior Publication Data

US 2013/0138022 A1 May 30, 2013

(51) Int. Cl.

| | |
|---|---|
| ***A61H 1/00*** | (2006.01) |
| ***A61H 23/02*** | (2006.01) |
| ***A61H 23/00*** | (2006.01) |

(52) U.S. Cl.

CPC ..... *A61H 1/008* (2013.01); *A61H 23/0254* (2013.01); *A61H 2201/0107* (2013.01); *A61H 2201/0119* (2013.01); *A61H 2201/0142* (2013.01); *A61H 2201/0165* (2013.01); *A61H 2201/0173* (2013.01); *A61H 2201/018* (2013.01); *A61H 2205/081* (2013.01); *A61H 23/006* (2013.01); *Y10S 5/915* (2013.01)

(58) Field of Classification Search

CPC . A61H 1/008; A61H 23/0254; A61H 23/006; A61H 2201/0107; A61H 2201/0119; A61H 2201/0142; A61H 2201/0173; A61H 2201/018; A61H 2005/081

USPC ..... 601/46, 49, 67, 69, 70, 79, 84, 86, 89, 601/90, 93, 97, 98, 101, 107, 108, 134; 5/915

See application file for complete search history.

(56) References Cited

U.S. PATENT DOCUMENTS

| | | | | |
|---|---|---|---|---|
| 6,602,211 | B2 * | 8/2003 | Tucek | 601/97 |
| 7,169,169 | B2 * | 1/2007 | Tucek et al. | 601/108 |
| 2006/0264788 | A1 * | 11/2006 | Chou | 601/15 |
| 2006/0282025 | A1 * | 12/2006 | McDonald et al. | 601/46 |
| 2007/0208283 | A1 * | 9/2007 | Neff | 601/49 |
| 2014/0128780 | A1 * | 5/2014 | Kennedy et al. | 601/18 |

* cited by examiner

*Primary Examiner* — Quang D Thanh
(74) *Attorney, Agent, or Firm* — Dale J. Ream

(57) ABSTRACT

A vibrating device for use in comforting an infant includes a motor and an arm operatively coupled to the motor. The arm includes a first end operatively coupled to the motor and a distal end displaced from the proximal end, the arm being repeatedly movable between first and second configurations when the motor is energized. A pad member is fixedly connected to the distal end of the arm, the pad member having a soft construction configured to prevent injury when pad member contacts an infant. The vibrating device includes a housing including side walls defining an interior area configured to contain the motor. A housing side wall defines an aperture through which the arm extends away from the motor.

10 Claims, 6 Drawing Sheets

VIBRATION DEVICE FOR COMFORTING AN INFANT

BACKGROUND OF THE INVENTION

This invention relates generally to vibration devices and, more particularly, to a vibrating device specifically configured for use in comforting an infant or toddler to the point of encouraging the infant to fall asleep.

Parents, grandparents, babysitters, or other caregivers have all tried various methods to help an infant get to sleep for a nap or for the night. Such methods may include rocking the baby in a chair, carrying the baby around the house, singing, or even going for a drive. In the end, however, the most frequently used method includes some form of gently patting the baby's back and/or bottom until the baby is soundly asleep. Sometimes the caregiver even continues to pat the baby's back after laying him or her down in the baby bed to verify that the baby is fast asleep.

Various devices have been proposed in the prior art to vibrate in a manner that is soothing when rested against a person's skin or pressed against a person's sore muscles. Although assumably effective for their intended purposes, the existing devices and proposals do not provide a vibratory device that can be configured to simulate the patting that a caregiver provides while helping an infant go to sleep.

Therefore, it would be desirable to have a vibratory device that is configured to assist in patting an infant's back as an assistant to a caregiver's attempt to put the baby to sleep. Further, it would be desirable to have a vibration device that may be coupled to the inside of a baby bed and positioned to automatically and safely pat a baby's back without direct supervision or involvement of a caregiver.

SUMMARY OF THE INVENTION

A vibrating device according to a preferred embodiment of the present invention for use in comforting an infant includes a motor and an arm operatively coupled to the motor. The arm includes a first end operatively coupled to the motor and a second or distal end displaced from the proximal end, the arm being repeatedly movable between first and second configurations when the motor is energized. A pad member is fixedly connected to the distal end of the arm, the pad member having a soft construction configured to prevent injury when the pad member contacts an infant. The vibrating device includes a housing including side walls defining an interior area configured to contain the motor. A housing side wall defines an aperture through which the arm extends away from the motor. When the motor is energized, the arm vibrates up and down so as to pat a baby's back.

Therefore, a general object of this invention is to provide a vibrating device specifically configured to pat the back or bottom of an infant so as to comfort the infant or assist in putting the infant to sleep.

Another object of this invention is to provide a vibrating device, as aforesaid, having a motor, an arm operatively coupled to the motor, and a pad situated at a distal end of the arm for patting a baby's back or bottom when the motor is energized.

Still another object of this invention is to provide a vibrating device, as aforesaid, that may be selectively coupled to a spindle of a baby crib and positioned so that an arm may be positioned to pat a baby's back.

Yet another object of this invention is to provide a vibrating device, as aforesaid, having padding situated on the arm and pad member to prevent injury to the infant when the motor is energized.

A further object of this invention is to provide a vibrating device, as aforesaid, that includes a support stand so that the vibrating device may be selectively positioned on the floor.

A still further object of this invention is to provide a vibrating device, as aforesaid, that is easy to use and safe in operation.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A vibration device for patting an infant's back according to a preferred embodiment of the present invention will now be described in detail with reference to FIGS. 1 to 6 of the accompanying drawings. In general, the vibration device 10 includes a motor 32, an arm 40 coupled to the motor 32 and configured to reciprocate, and a pad member 34 connected to the arm 40 for contacting a baby's back.

Figure 5:
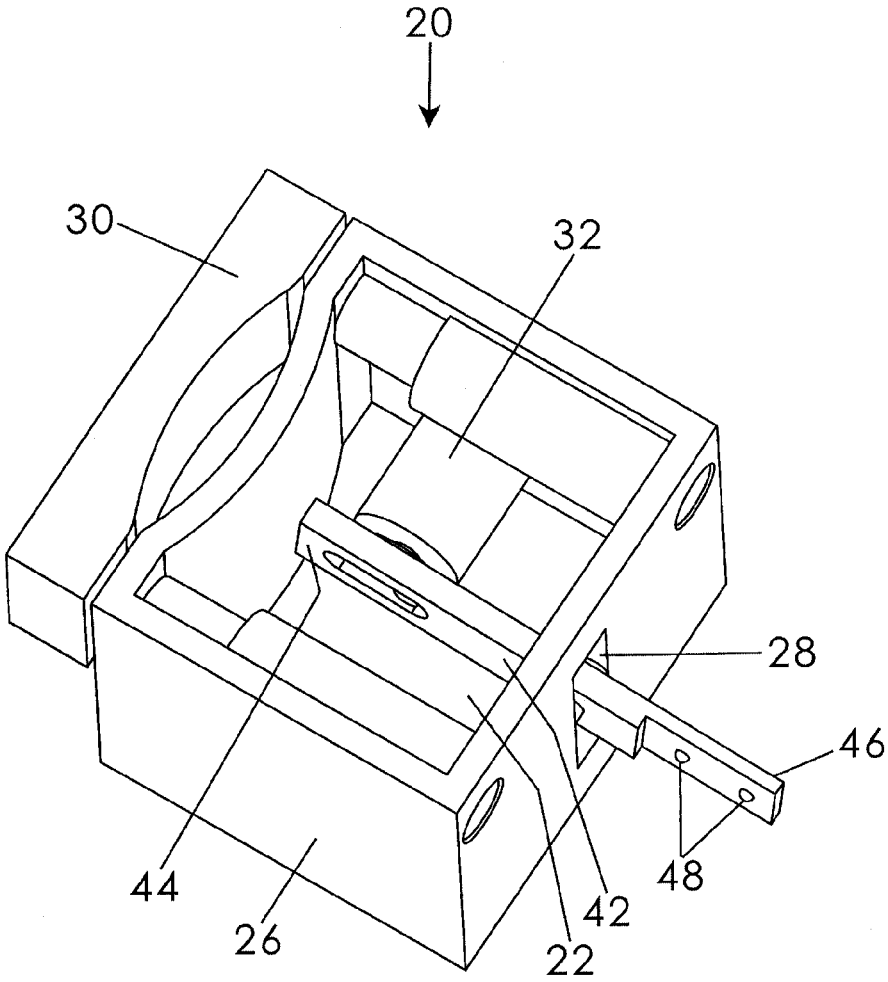
FIG. 5 is an isolated view of the housing as in FIG. 3 on an enlarged scale with a top wall thereof removed.
Figure 6A:
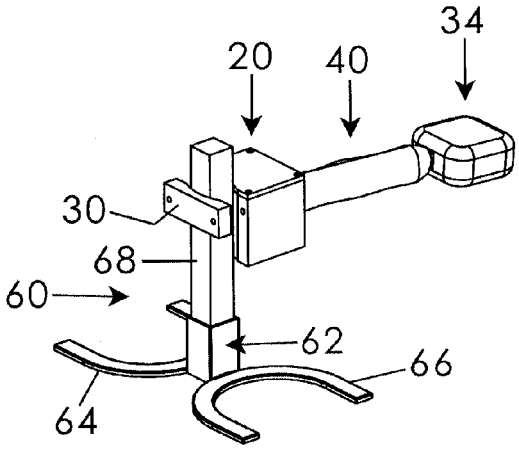
FIG. 6*a* is a perspective of the vibrating device as in FIG. 2 in use with a support stand.
Figure 6B:
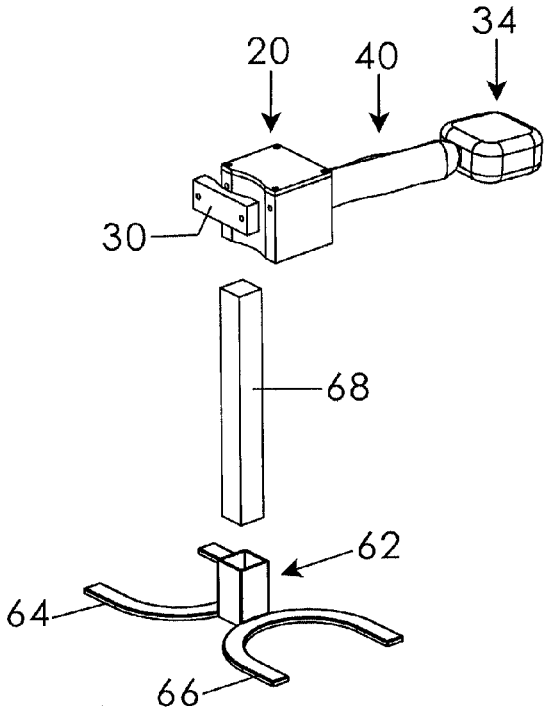
FIG. 6*b* is an exploded view of the vibrating device and support stand as in FIG. 6*a*.

The vibration device 10 includes a housing 20 having a bottom wall 22, a top wall 24, and a plurality of side walls 26 extending upwardly from the bottom wall 22 (FIG. 5). Together, the walls define an interior area configured to contain the motor 32. One of the side walls 26, which may also be referred to as a front wall, defines an aperture 28 that extends substantially between the bottom wall 22 and top wall 24. The top wall 24 may be removable from its attachment to the side walls 26 by removing corresponding fasteners so that a user may access the interior area, such as to repair or replace component parts or batteries. Another of the side walls, which may more particularly be referred to as a rear wall, is opposite the front wall. A clamp member 30 may be removably coupled to an outer surface of the rear wall, the clamp member 30 being configured to selectively couple the vibration device 10 to a piece of furniture such as, for example, a spindle 8 of a baby bed 6. As shown, the clamp member 30 may be secured with fasteners that extend through the clamp member 30 and through the housing interior area.

The motor 32 is positioned in the interior area of the housing 20 (FIG. 5). The motor 32 may be a high frequency vibration motor or, alternatively, may be a reciprocating motor. The motor 32 may be powered by batteries (not shown). The arm 40 may include a first portion 42 having a first end 44 operatively coupled to the motor 32 inside the housing 20 (FIG. 5). The first portion 42 includes a second end 46 opposite the first end 44 (FIGS. 4*a* and 4*b*), the second end 46 of the first portion 42 extending through the aperture 28 and away from the housing 20. Further, the arm 40 includes a second portion 50 having a first end 52 removably or detachably coupled to the first portion second end 46 when a predetermined amount of pulling force is exerted upon or applied to the second portion 50 as will be further described below. The second portion 50 of the arm 40 includes a second end 54 opposite the second portion first end 52, the second portion second end 54 also being referred to as a second portion distal end.

More particularly, the second portion first end 52 may be magnetically connected to the first portion second end 46. The first portion second end 46 has a configuration that is complementary to a configuration of the second portion first end 52. For instance, respective ends may include less that a full thickness such that a normal thickness is presented when the ends are situated adjacent to one another. In other words, respective ends may be situated side by side as a result of their respective reduced thicknesses as can be appreciated by comparing FIG. 2 with FIG. 4*b*.

Figure 4A:
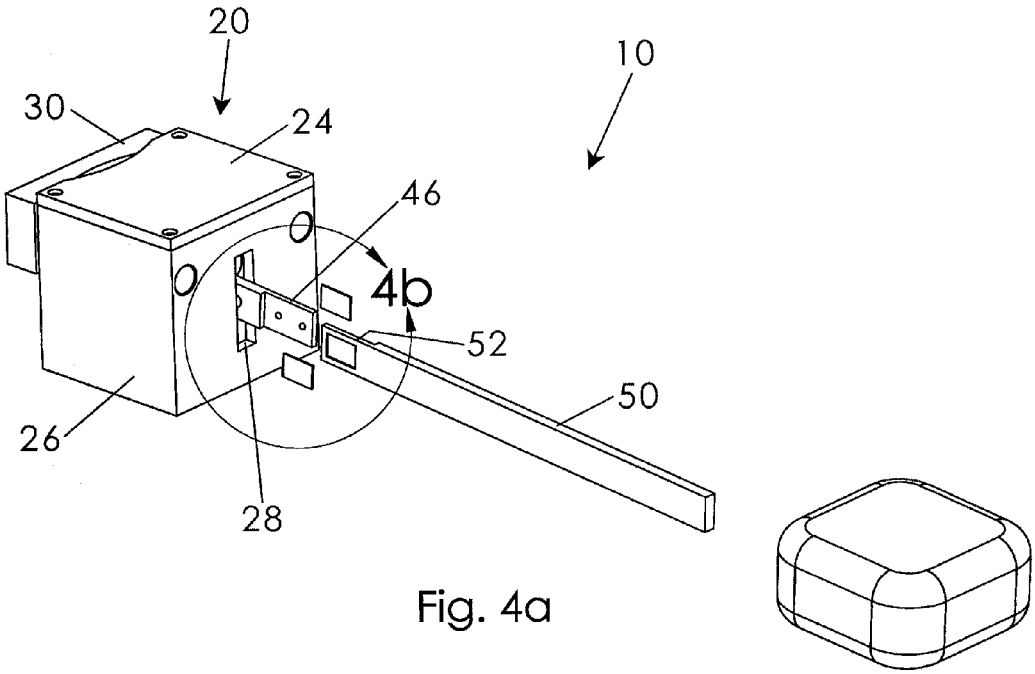
FIG. 4*a* is an exploded view of the vibrating device as in FIG. 3.
Figure 4B:
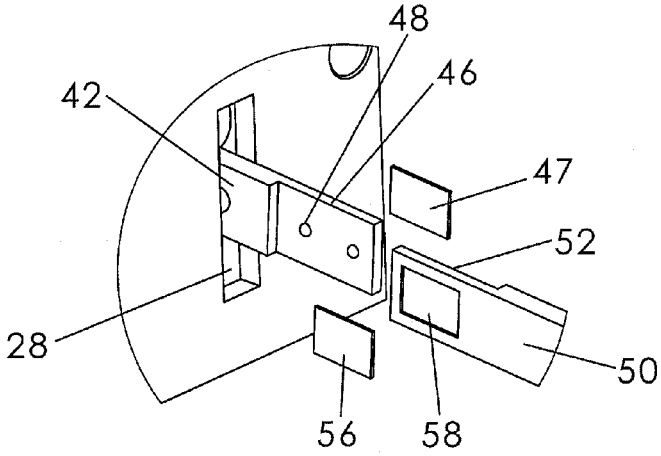
FIG. 4*b* is an isolated view on an enlarged scale taken from a portion of FIG. 4*a;*

The magnetic coupling of the second portion 50 to the first portion 42 is best seen in FIGS. 4*a* and 4*b*. The first portion second end 46 includes a first magnet 47. The second portion first end 52 includes a second magnet 56. The magnets are configured so as to be magnetically attracted to one another so that the first portion 42 is releasably coupled to the second portion 50. Even more particularly, the first portion second end 46 may define at least one aperture 48 aligned with the first magnet 47. Similarly, the second portion first end 52 may define a void 58 aligned with the second magnet 56. It is understood that the aperture 48 and void 58 enable the first magnet 47 and second magnet 56 to be more strongly attracted to one another, respectively.

Figure 1:
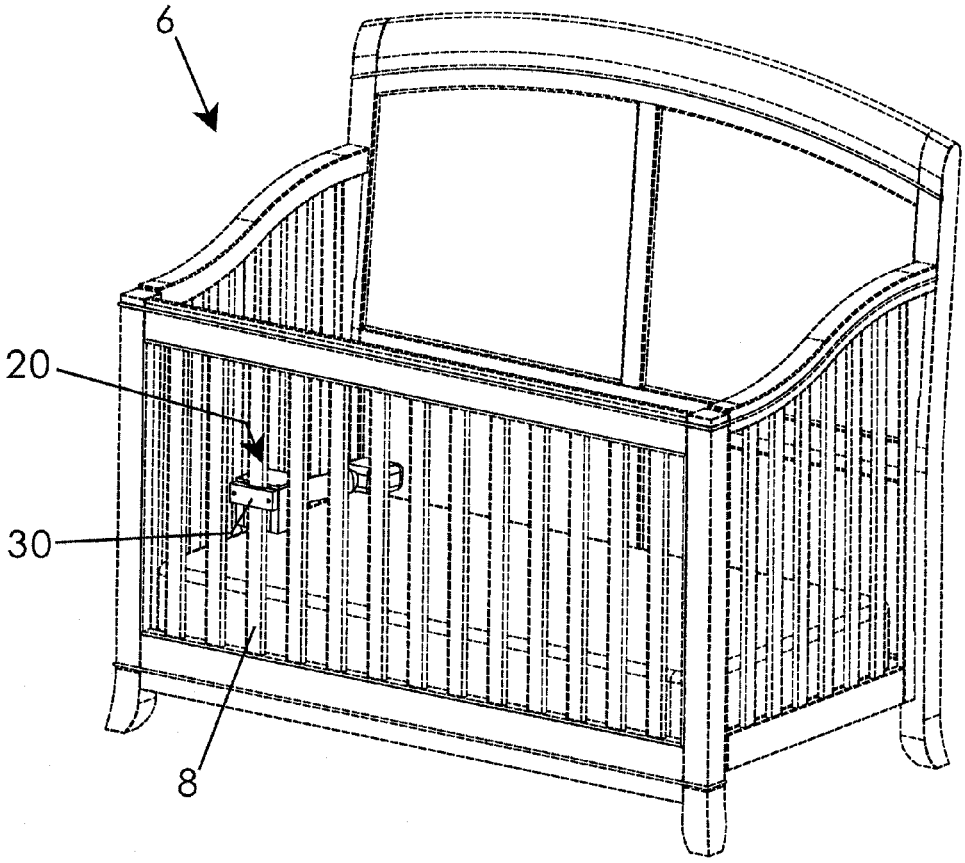
FIG. 1 is a perspective view of a vibrating device for use in comforting an infant according to a preferred embodiment of the present invention and illustrated connected to a baby bed.
Figure 2:
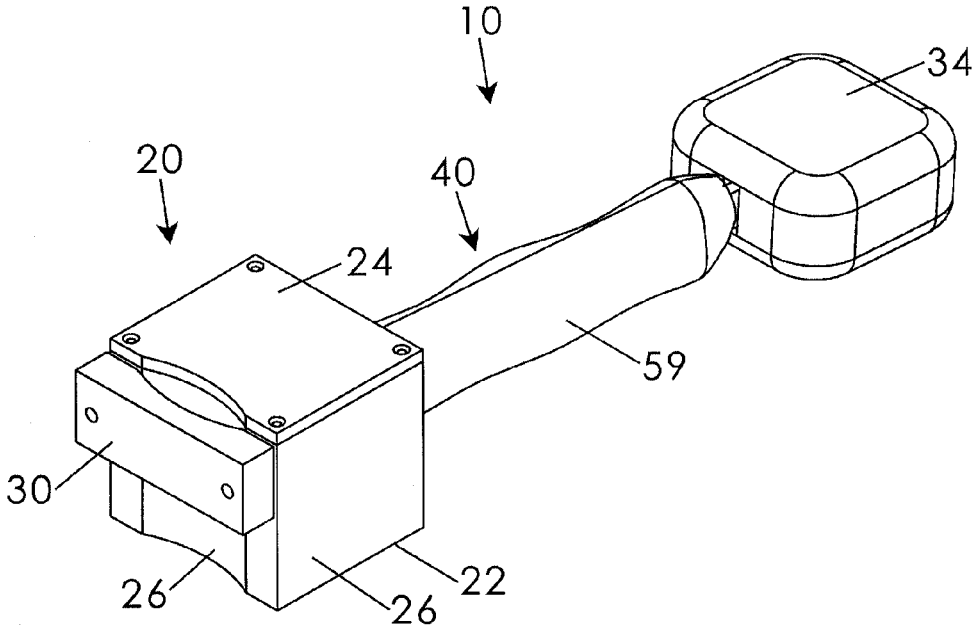
FIG. 2 is a perspective view of the vibrating device as in FIG. 1 removed from the baby bed.
Figure 3:
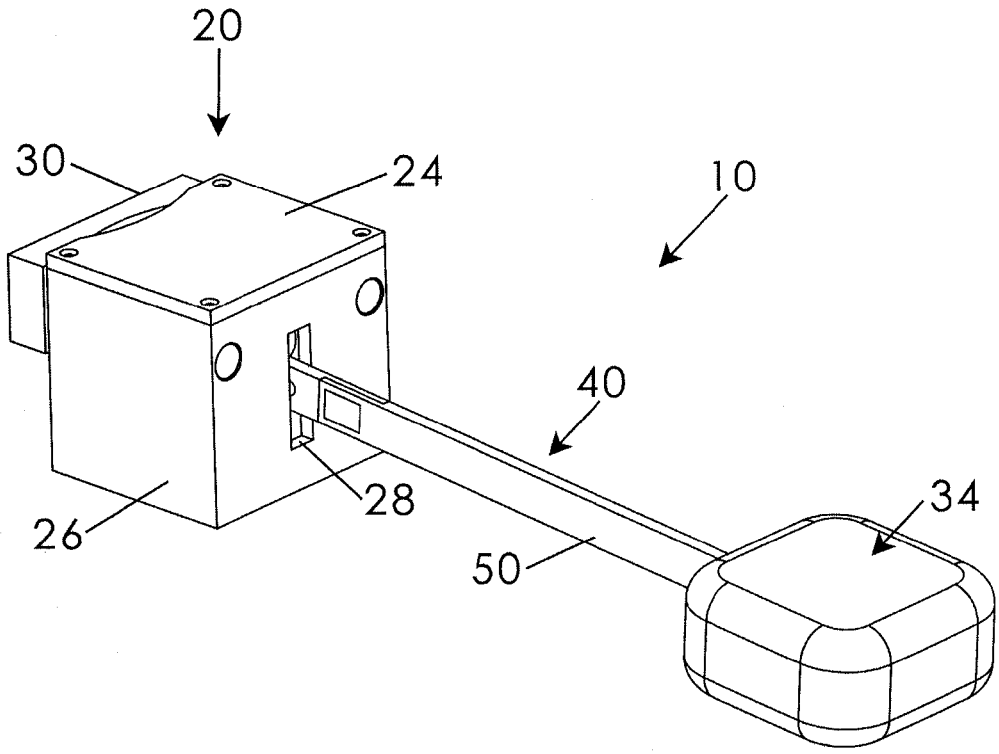
FIG. 3 is a perspective view from another angle of the vibrating device as in FIG. 2 with a sleeve padding removed.

As shown in FIG. 2, the vibration device 10 may include a sleeve 59 configured to surround the arm 40 substantially between the point where it exits the housing 20, i.e. at the aperture 28, to its distal end 54 adjacent the pad member 34. Preferably, the pad member 34 and sleeve 59 are constructed of a soft or padded material configured to prevent or minimize injury if or when the arm 40 may come into contact with an infant during use.

The vibration device 10 may also include a support stand 60 that enables the device to be used apart from a baby bed 6, such as to be utilized on a floor surface or on an adult sized bed. The support stand 60 may include a base member 62 and a support post 68 extending upwardly from the base member 62. It is understood that the support post 68 includes a configuration that is complementary to the clamp member 30 such that the clamp member 30 may be selectively coupled thereto in the same manner as it is intended to be coupled to a baby bed spindle 8. The base member 62 may include a first base portion 64 and a second base portion 66. Each respective base portion may include a generally U-shaped configuration defining an open end directed away from the support post 68. It is believed that this configuration provides a beneficial stability to the base member 62.

In use, the vibrating device 10 may be positioned adjacent an infant that is lying on his stomach, such as by coupling the clamp member 30 to a baby bed spindle 8 or by coupling the clamp to the support post 68 of the support stand 60. The motor 32 may then be actuated such as by pressing an on/off button (not shown) or the like. When the motor 32 is energized, the arm 40 is repeatedly and perhaps quickly moved up and down such that the pad member 34 may repeatedly pat the back or bottom of an infant.

It is understood that while certain forms of this invention have been illustrated and described, it is not limited thereto except insofar as such limitations are included in the following claims and allowable functional equivalents thereof.

What is claimed is:

1. A vibrating device for use in comforting an infant, comprising:

a motor;

an arm having a proximal end operatively coupled to said motor and a distal end displaced from said proximal end, said arm being repeatedly movable between first and second configurations when said motor is energized;

a pad member fixedly connected to said distal end of said arm, said pad member having a soft construction configured to prevent injury when said pad member contacts an infant;

a housing having a bottom wall, a top wall, and a plurality of side walls extending upwardly from said bottom wall and configured to define an interior area, at least one of said plurality of side walls defining an aperture;

wherein said motor and said arm proximal end are contained in said housing interior area, said arm extending through said aperture and away from said housing;

wherein said arm includes:

a first portion having a first end operatively coupled to said motor and an opposed second end adjacent said aperture; and a second portion having a first end removably coupled to said first portion second end and configured to detach from said first portion first end when a predetermined amount of pulling force is exerted on said second portion;

wherein said second portion is magnetically connected to said first portion;

wherein said first portion second end has a configuration complementary to a configuration of said second portion first end such that said first portion second end is adjacent to said second portion first end when said first and second portions are coupled together;

wherein:

said first portion second end includes a first magnet;

said second portion first end includes a second magnet; and said first and second magnets are configured to be attracted to one another so as to selectively couple said first portion of said arm to said second portion of said arm;

wherein:

said first portion second end defines an aperture aligned with said first magnet;

said second portion first end defines a void aligned with said second magnet; and said aperture and said void are configured such that said second magnet is magnetically attracted to said first magnet.

2. The vibrating device as in claim 1, wherein said top wall is removably coupled to said plurality of side walls with a fastener.

3. The vibrating device as in claim 2, wherein one of said plurality of side walls is a rear wall opposite said aperture; said vibrating device further comprising a clamp member removably coupled to an outer surface of said rear wall such that said housing is selectively mounted to a piece of furniture.

4. The vibrating device as in claim 1, wherein said motor is a vibrating motor.

5. The vibrating device as in claim 1, wherein said motor is a reciprocating motor.

6. The vibrating device as in claim 1, wherein said aperture spans substantially between said bottom wall and said top wall.

7. The vibrating device as in claim 1, further comprising a sleeve coupled to said arm and configured to surround said arm substantially between said aperture and said pad member, said sleeve being constructed of a soft material configured to prevent injury when said arm contacts an infant.

8. The vibrating device as in claim 1, further comprising a support stand having a base member and a support post extending upwardly from said base member, said support post being configured to be selectively coupled to a clamp member.

9. The vibrating device as in claim 1, wherein said base member of said support stand includes a first base portion having a generally U-shaped configuration that defines an open end extending away from said support post and a second base portion having a generally U-shaped configuration that defines an open end extending away from said support post in a direction opposite that of said first base portion.

10. The vibrating device as in claim 8, further comprising a sleeve coupled to said arm and configured to surround said arm substantially between said aperture and said pad member, said sleeve being constructed of a soft material configured to prevent injury when said arm contacts an infant.

* * * * *